US010741137B2

(12) United States Patent
Bai et al.

(10) Patent No.: US 10,741,137 B2
(45) Date of Patent: Aug. 11, 2020

(54) DISPLAY DRIVING DEVICE AND METHOD, AND DISPLAY PANEL

(71) Applicants: BOE TECHNOLOGY GROUP CO., LTD., Beijing (CN); CHONGQING BOE OPTOELECTRONICS TECHNOLOGY CO., LTD., Chongqing (CN)

(72) Inventors: Wangjing Bai, Beijing (CN); Yihjen Hsu, Beijing (CN)

(73) Assignees: CHONGQING BOE OPTOELECTRONICS TECHNOLOGY CO., LTD., Chongqing (CN); BOE TECHNOLOGY GROUP CO., LTD., Beijing (CN)

( * ) Notice: Subject to any disclaimer, the term of this patent is extended or adjusted under 35 U.S.C. 154(b) by 140 days.

(21) Appl. No.: 15/766,812

(22) PCT Filed: Sep. 19, 2017

(86) PCT No.: PCT/CN2017/102274
§ 371 (c)(1),
(2) Date: Apr. 7, 2018

(87) PCT Pub. No.: WO2018/176746
PCT Pub. Date: Oct. 4, 2018

(65) Prior Publication Data

US 2019/0073971 A1 Mar. 7, 2019

(30) Foreign Application Priority Data

Mar. 31, 2017 (CN) ..... 2017 1 0209191

(51) Int. Cl.
*G09G 3/36* (2006.01)

(52) U.S. Cl.
CPC ..... *G09G 3/3648* (2013.01); *G09G 3/3614* (2013.01); *G09G 3/3688* (2013.01);
(Continued)

(58) Field of Classification Search
None
See application file for complete search history.

(56) References Cited

U.S. PATENT DOCUMENTS

2007/0164963 A1* 7/2007 Kim ..... G09G 3/3655 345/98
2015/0340002 A1* 11/2015 Hu ..... G09G 3/3607 345/89
2016/0343328 A1* 11/2016 Li ..... G09G 3/3659

FOREIGN PATENT DOCUMENTS

CN 101408705 A 4/2009
CN 102930816 A 2/2013
(Continued)

OTHER PUBLICATIONS

International Search Report and Written Opinion dated Jan. 3, 2018 in PCT/CN2017/102274.
(Continued)

*Primary Examiner* — Brian M Butcher
(74) *Attorney, Agent, or Firm* — Syncoda LLC; Feng Ma

(57) ABSTRACT

A display driving device is provided, which includes a detecting circuit, a comparing circuit coupled to the detecting circuit, and a timing control circuit coupled to the comparing circuit. The detecting circuit detects, and sends to the comparing circuit, a common voltage from each of a plurality of regions in the display panel. The comparing circuit compares the common voltage with a reference voltage and determines whether it is normal. Based on the determination result from the comparing circuit, the timing control circuit adjusts a data voltage of a region having an abnormal common voltage so as to allow a positive data
(Continued)

voltage and a negative data voltage of the region to be symmetrical to the common voltage of the region. A display driving method based on the display driving device and a display apparatus having the display driving device are also disclosed.

17 Claims, 6 Drawing Sheets

(52) U.S. Cl.
CPC ..... *G09G 3/3696* (2013.01); *G09G 2310/08* (2013.01); *G09G 2320/0247* (2013.01)

(56) References Cited

FOREIGN PATENT DOCUMENTS

| | | | |
|---|---|---|---|
| CN | 102930844 | A | 2/2013 |
| CN | 2891438 | Y | 4/2017 |

OTHER PUBLICATIONS

1st Office Action dated Sep. 11, 2019 in CN201710209191.6.
2st Office Action dated Mar. 26, 2020 in CN201710209191.6.

* cited by examiner

DISPLAY DRIVING DEVICE AND METHOD, AND DISPLAY PANEL

CROSS-REFERENCE TO RELATED APPLICATION

The present application claims priority to Chinese Patent Application No. 201710209191.6 filed on Mar. 31, 2017, the disclosure of which is hereby incorporated by reference in its entirety.

TECHNICAL FIELD

The present disclosure relates generally to the field of display technologies, and specifically to a display driving device and method, and a display apparatus.

BACKGROUND

Due to advantages such as small sizes, low energy consumption, no radiation, and low manufacturing costs, thin-film transistor liquid crystal displays (TFT-LCD) have been dominating the current market of flat panel displays.

A TFT-LCD primarily comprises an array substrate and a color film substrate, which are oppositely disposed in the display apparatus. The array substrate typically includes gate lines, data lines, pixel electrodes and thin-film transistors. Each pixel electrode is controlled by a thin-film transistor. Upon turn-on of the thin-film transistor, the pixel electrode is charged during the turn-on period, and upon turn-off of the thin-film transistor, the pixel electrode will have a voltage that can be sustained until being charged again during the next scanning.

SUMMARY

In order to address the issues associated with current LCD display technologies, the present disclosure provides a display driving device, a display driving method, and a display apparatus.

In a first aspect, a display driving device for driving a display panel is disclosed. The display driving device includes a detecting circuit, a comparing circuit that is coupled to the detecting circuit, and a timing control circuit that is coupled to the comparing circuit.

The detecting circuit is configured to detect, and to send to the comparing circuit, a common voltage from each of at least one of a plurality of regions in the display panel. The comparing circuit is configured to compare the common voltage with a reference voltage, to determine whether the common voltage is normal, and to send a determination result to the timing control circuit. The timing control circuit is configured, based on the determination result, to adjust a data voltage of a region having a common voltage determined to be abnormal so as to allow a positive data voltage and a negative data voltage of the region to be symmetrical to the common voltage of the region.

According to some embodiments of the display driving device, the comparing circuit comprises a subtraction operator and a same-phase hysteresis comparator. The subtraction operator is configured to calculate, and to send to the same-phase hysteresis comparator, an absolute value of a voltage difference between the reference voltage and the common voltage from the each of the plurality of regions. The same-phase hysteresis comparator is configured to convert the absolute value of the voltage difference into a logic signal.

In the display driving device as described above, the detecting circuit can be coupled to an input terminal of the subtraction operator, an output terminal of the subtraction operator can be coupled to an input terminal of the same-phase hysteresis comparator, and an output terminal of the same-phase hysteresis comparator can be coupled to the timing control circuit.

In the display driving device as described above, the subtraction operator can include a first capacitor, a second capacitor, a first resistor, a second resistor, a third resistor, a seventh resistor, and a first comparator.

Herein a first terminal of the first capacitor is coupled to a first low level terminal; a second terminal of the first capacitor is coupled to a common voltage terminal of the detecting circuit corresponding to the each of the plurality of regions and a first terminal of the first resistor; a first terminal of the second capacitor is coupled to a second low level terminal and a first terminal of the third resistor; a second terminal of the second capacitor is coupled to the reference voltage terminal and a first terminal of the second resistor; a second terminal of the first resistor is coupled to a first terminal of the first comparator and a first terminal of the seventh resistor; a second terminal of the second resistor is coupled to a second terminal of the first comparator and a second terminal of the third resistor; and a second terminal of the seventh resistor is coupled to a third terminal of the first comparator.

In the display driving device as described above, the same-phase hysteresis comparator can include a fourth resistor, a fifth resistor, a sixth resistor, an eighth resistor, and a second comparator.

It is configured such that a first terminal of the fourth resistor is coupled to the third terminal of the first comparator; a second terminal of the fourth resistor is coupled to a first terminal of the eighth resistor and a first terminal of the second comparator; a first terminal of the fifth resistor is coupled to a power source; a second terminal of the fifth resistor is coupled to a second terminal of the second comparator and a first terminal of the sixth resistor; a second terminal of the sixth resistor is coupled to a third low level terminal; a second terminal of the eighth resistor is coupled to a third terminal of the second comparator; and the third terminal of the second comparator is coupled to the timing control circuit.

According to some embodiments of the display driving device, the comparing circuit further includes a reference voltage controller, which is coupled to the subtraction operator and is configured to control a threshold range of the reference voltage.

In these above mentioned embodiments, the display driving device can further include a compensation circuit, and it is configured such that a first terminal thereof is coupled to the display panel, and a second terminal thereof is coupled to the reference voltage controller. The compensation circuit is configured to compensate for the common voltage of the each of the plurality of regions based on the reference voltage.

According to some embodiments of the display driving device, the each of at least one of the plurality of regions is an edge region of the display panel. Furthermore, the display panel can be divided into nine regions, and the at least one of the plurality of regions consist of eight regions that are each the edge region.

According to some embodiments of the display driving device, the detecting circuit comprises a plurality of detecting lines, which are coupled to the plurality of regions, and it is configured such that each of the plurality of detecting lines is coupled to one of the plurality of regions, and is configured to respectively obtain one common voltage therefrom.

In a second aspect, the present disclosure further provides a method for driving a display panel. The method includes the following steps:

detecting a common voltage from each of a plurality of regions in a display panel;

determining whether the common voltage from the each of the plurality of regions is normal; and adjusting a data voltage of a region if a common voltage of the region is determined to be abnormal.

In the method, the step of determining whether the common voltage from the each of the plurality of regions is normal can include the following sub-steps:

comparing the common voltage from the each of the plurality of regions with a reference voltage to thereby obtain a deviation of the common voltage; and determining that the common voltage is abnormal if the deviation of the common voltage is more than a threshold, or normal if otherwise.

Herein the threshold can be more than 0 and no less than n, where $0.3 \leq n \leq 0.6$.

In the method, the sub-step of comparing the common voltage from the each of the plurality of regions with a reference voltage to thereby obtain a deviation of the common voltage can include:

calculating an absolute value of a voltage difference between the reference voltage and the common voltage from the each of the plurality of regions.

In the method, after the sub-step of determining that the common voltage is abnormal if the deviation of the common voltage is more than a threshold, or normal if otherwise, the step of determining whether the common voltage from the each of the plurality of regions is normal further includes a sub-step of:

converting the absolute value of the voltage difference into a logic signal.

According to some embodiments of the method, the step of adjusting a data voltage of a region if a common voltage of the region is determined to be abnormal includes a sub-step of:

adjusting the data voltage of the region such that a positive data voltage and a negative data voltage of the region are symmetrical to the common voltage of the region.

In the method as described above, the sub-step of adjusting the data voltage of the region comprises:

lowering a positive potential signal from a signal source to thereby allow a symmetry with a negative potential signal.

According to some embodiments of the method, each of the plurality of regions is an edge region of the display panel. More specifically, the display panel can be divided into nine regions, and the plurality of regions consist of eight regions that are each an edge region.

In a third aspect, the present disclosure further provides a display apparatus. The display apparatus includes a display driving device according to any of the embodiments as described above.

BRIEF DESCRIPTION OF THE DRAWINGS

To more clearly illustrate some of the embodiments disclosed herein, the following is a brief description of the drawings. The drawings in the following descriptions are only illustrative of some embodiments. For those of ordinary skill in the art, other drawings of other embodiments can become apparent based on these drawings.

DETAILED DESCRIPTION

The applicants have observed that in a conventional display panel having thin-film transistors (TFTs), a capacitor (Cgs) is commonly formed between a gate electrode and a source electrode of a thin-film transistor, which is a determining factor for pulling down the pixel electrode voltage by the gate electrode voltage. During a conventional manufacturing process of a thin-film transistor, an overlay offset between the gate electrode layer and the source-drain electrode layer commonly occurs, and for current thin-film transistor designs, a constant Cgs cannot be guaranteed.

The greater the Cgs, the greater the pixel electrode voltage that has been pulled down ($\Delta Vp$), and the greater the gray scale difference in the same signal voltage when the reversal of polarity occurs. Consequently, the images that are displayed flicker.

In order to address the issues as described above, the present disclosure provides a display driving device and method, and a display apparatus.

In the following, with reference to the drawings of various embodiments disclosed herein, the technical solutions of the embodiments of the disclosure will be described in a clear and fully understandable way.

It is obvious that the described embodiments are merely a circuit but not all the embodiments of the disclosure. Based on the described embodiments of the disclosure, those ordinarily skilled in the art can obtain other embodiment(s), which come(s) within the scope sought for protection by the disclosure.

Figure 1:
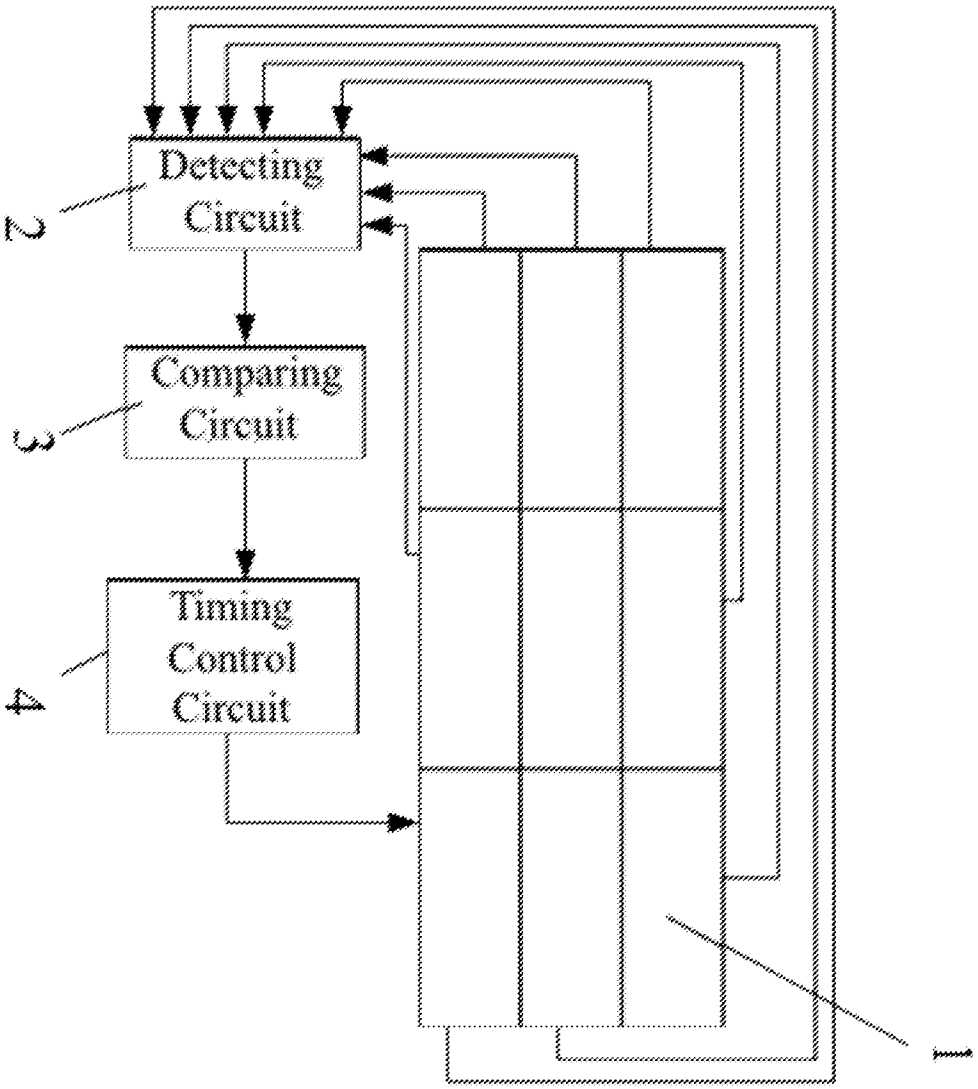
FIG. 1 is a schematic diagram of a display driving device disclosed herein.

In a first aspect, a display driving device is disclosed, which is illustrated in FIG. 1. The display driving device includes a detecting circuit 2, a comparing circuit 3, and a timing control circuit 4. The comparing circuit 3 is coupled with the detecting circuit 2, and the timing control circuit 4 is coupled with the comparing circuit 3.

The detecting circuit 2 is configured to detect, and to send to the comparing circuit 3, a common voltage from each of a plurality of regions in the display panel 1. The comparing circuit 3 is configured to compare the common voltage from each of the plurality of regions in the display panel 1 with a reference voltage, to determine whether the common voltage is normal, and to send a determination result to the timing control circuit 4. The timing control circuit 4 is configured, based on the determination result sent from the comparing circuit 3, to adjust a data voltage of a region having a common voltage determined to be abnormal so as to allow a positive data voltage and a negative data voltage of the region to be symmetrical to the common voltage of the region.

Herein and elsewhere in the disclosure, the criteria for judging whether the common voltage is normal is defined as follows. If the common voltage is within a predetermined range, it is considered as normal. Accordingly, if the common voltage is out of the predetermined range, it is considered as abnormal.

In this embodiment of the display driving device as described above, the display panel 1 is divided into a plurality of regions, and by means of the detecting circuit 2 of the display driving device, a common voltage from each of the plurality of regions is detected.

The comparing circuit 3 examines a common voltage from each region to determine whether the common voltage from each region is normal, and then performs a conversion processing to the determination result before sending the processed determination result to the timing control circuit 4.

Based on the processed determination result received from the comparing circuit 3, the timing control circuit 4 adjusts a data voltage of the region having a relatively large deviation of the common voltage to thereby allow the positive data voltage and the negative data voltage of the region to be symmetrical to the common voltage of the region.

Figure 2:
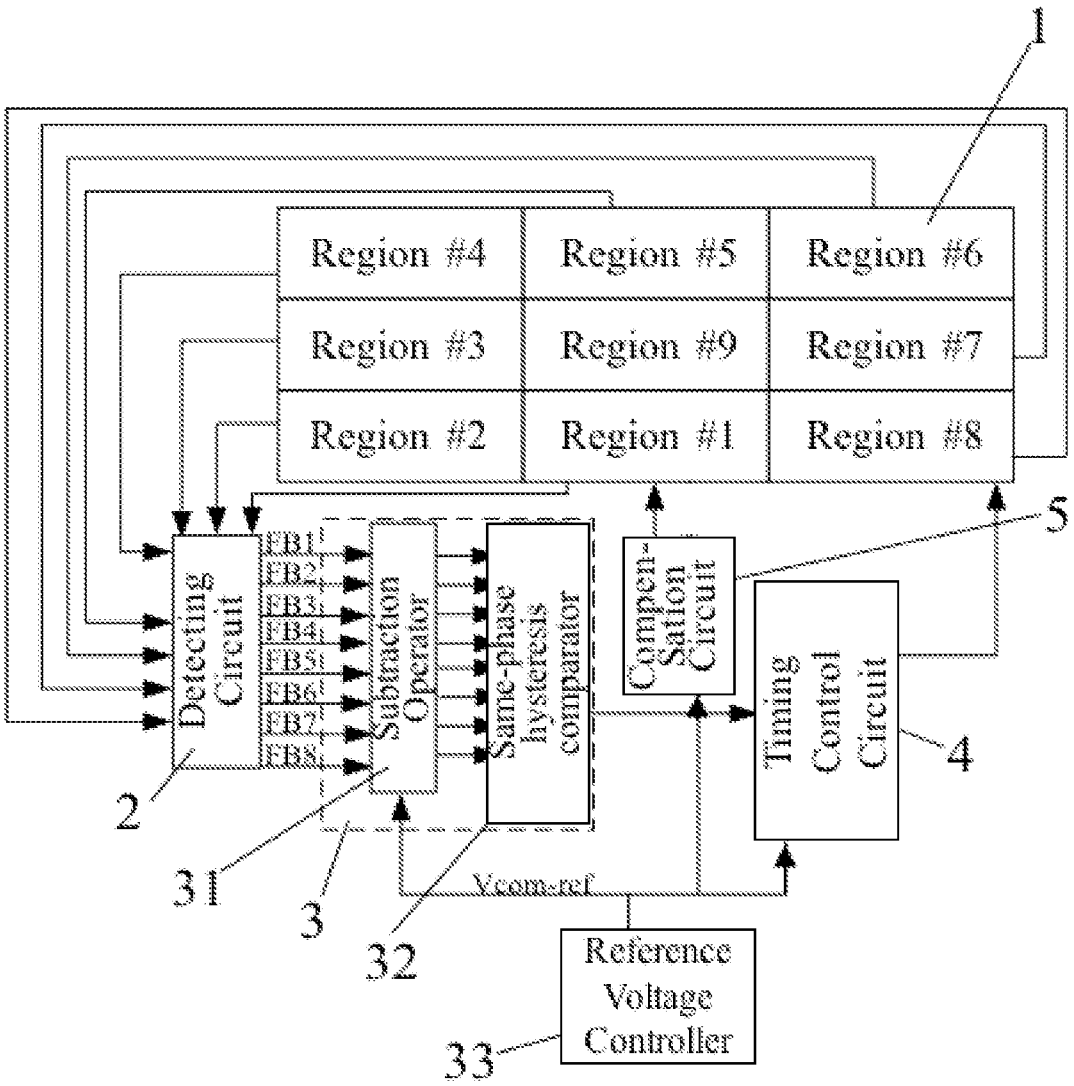
FIG. 2 is a schematic diagram of a display driving device according to some embodiments of the present disclosure.

As such, by means of the display driving device as disclosed herein, the issue of display panel flickering can be effectively alleviated. In addition, because the correction process of screen flickering can be automatic, the cost associated with manual adjustment of the common voltage can be saved FIG. 2 illustrates a display driving device according to some embodiment of the disclosure. As illustrated in FIG. 2, the display panel 1 is divided into a total of nine regions, and the display driving device includes a detecting circuit 2, a comparing circuit 3, and a timing control circuit 4. The comparing circuit 3 is coupled with the detecting circuit 2, and the timing control circuit 4 is coupled with the comparing circuit 3.

The detecting circuit 2 is configured to detect, and to send to the comparing circuit 3, a common voltage from each of the nine regions in the display panel 1. The comparing circuit 3 is configured to compare the common voltage from each region in the display panel 1 with a reference voltage, to determine whether the common voltage is normal, and to send the determination result to the timing control circuit 4. The timing control circuit 4 is configured, based on the determination result sent from the comparing circuit 3, to adjust a data voltage of a region having an abnormal common voltage to thereby allow the positive and negative data voltage of the region to be symmetrical to the common voltage of the region.

In the above embodiment of the display driving device, the detecting circuit 2 includes a plurality of detecting lines, each coupled with each region of the display panel 1 and configured to respectively obtain the common voltage therefrom. In other words, the detecting circuit 2 detects each individual region of the display panel 1 by means of one individual detecting line.

It is noted that besides the total of nine regions in the display panel 1 as in the embodiment of the disclosure as illustrated in FIG. 2, the display panel 1 can be divided into a total of four regions, or into more regions such as a total of 25 regions. There is no limitation to the number of regions in the display panel 1.

It is further noted that it is not necessary to detect a common voltage from each and every region in the plurality of regions in the display panel 1, and that it is possible to only detect a common voltage from a sub-set, but not all, of the regions of the display panel 1. For example, a common voltage from a middle region or a center region (i.e. a region that is not next to a border of the display panel 1) is relatively stable, whereas a common voltage from an edge region (i.e. a region that is next to at least one border of the display panel 1, a region which has at least one boundary overlap with border of the display panel 1) is relatively not stable. Thus a middle region or a center can be skipped for detecting a common voltage therefrom.

In the above embodiment as illustrated in FIG. 2, the display panel 1 is illustratively divided into a total of nine regions (i.e., regions Nos.:1-9), and it is configured such that a common voltage from each of the eight edge regions (i.e. regions Nos.:1-8) is detected, whereas a common voltage from the center region (i.e. region Nos.:9) is skipped for detecting.

This above configuration, because of the convenience in arranging the detecting lines in the display driving device, can easily and readily realize a real-time adjustment to all the edge regions (i.e. regions Nos.: 1-8)

According to some embodiment of the disclosure, the comparing circuit 3 includes a subtraction operator 31 and a same-phase hysteresis comparator 32. The subtraction operator 31 is configured to separately calculate an absolute value of a voltage difference between the reference voltage and the common voltage from each of the eight edge regions (i.e. regions Nos.: 1-8). The same-phase hysteresis comparator 32 is configured to convert the absolute value of the voltage difference obtained from the subtraction operator 31 into a logic signal.

In other words, in the above mentioned embodiment of the comparing circuit 3 in the display driving device as illustrated in FIG. 2, upon detection of each individual common voltage corresponding to each of the eight edge regions (i.e. regions Nos.: 1-8), the detecting circuit 2 transmits each individual common voltage to the subtraction operator 31.

Then the subtraction operator 31 calculates an absolute value of each individual voltage difference between the reference voltage and each individual common voltage, and the same-phase hysteresis comparator 32 converts the absolute value of each individual voltage difference obtained from the subtraction operator 31 into a logic signal.

Specifically, the subtraction operator 31 performs the comparing calculation based on the following formulas $$\begin{cases} |(FB_x - V_{com_ref})| \le \varepsilon; \text{output } 0 \\ |(FB_x - V_{com_ref})| > \varepsilon; \text{output } 1 \end{cases}$$

where FBx is each individual common voltage corresponding to each individual region of the display panel 1 that has been detected; $V_{com_ref}$ is the reference voltage; ε is the deviation of each individual common voltage from the reference voltage.

Specifically, the deviation of each individual common voltage from the reference voltage can be set based on specific conditions, and can be typically set as between 0.3 and 0.6.

The same-phase hysteresis comparator 32 then converts the calculation results obtained from the subtraction operator 31 into one serial data. The all possible serial data and their corresponding instructions are summarized in Table 1, where in each cell, a number "1" means a voltage deviation (i.e. a voltage difference between a common voltage and the reference voltage) in a particular region determined to be relatively large, which indicates an unacceptable level of voltage deviation, and thus a need for adjustment, for that particular region; and a number "0" means a voltage deviation in a particular region determined to be relatively small, which indicates an acceptable level of voltage deviation, and thus no need for adjustment, for that particular region.

TABLE 1

| Region #1 | Region #2 | Region #3 | Region #4 | Region #5 | Region #6 | Region #7 | Region #8 | Region for correction |
|---|---|---|---|---|---|---|---|---|
| 1 | 0 | 0 | 0 | 0 | 0 | 0 | 0 | #1 |
| 0 | 1 | 0 | 0 | 0 | 0 | 0 | 0 | #2 |
| | | | ... | | | | | ... |
| 1 | 1 | 0 | 0 | 0 | 0 | 0 | 0 | #1, 2 |
| 0 | 0 | 1 | 1 | 0 | 0 | 0 | 0 | #3, 4 |
| | | | ... | | | | | ... |
| 1 | 1 | 1 | 0 | 0 | 0 | 0 | 0 | #1, 2, 3 |
| 0 | 0 | 0 | 1 | 1 | 1 | 1 | 0 | #4, 5, 6 |
| | | | ... | | | | | ... |

If one common voltage ($V_{com}$) in one region is relatively too large (i.e. the voltage deviation is at an unacceptable level), the timing control circuit 3 (TCON) is configured to adjust a data voltage corresponding to the one region, for example, by adjusting same-polarity data signal corresponding to the one region that has been outputted.

Typically, a common voltage ($V_{com}$) is biased towards a negative potential terminal, causing a non-symmetry. In correspondence to this situation, the positive potential signal provided from a signal source can be lowered to thereby guarantee a symmetry with the negative potential signal. As such, it can realize that a positive potential signal (i.e. the positive data voltage) and a negative signal (i.e. the negative data voltage) to be outputted are symmetrical relative to the common voltage ($V_{com}$), ultimately leading to an alleviation of the issue of flickering.

In some embodiment of the display driving device, an input terminal of the subtraction operator 31 is coupled or connected with the detecting circuit 2, an output terminal of the subtraction operator 31 is coupled or connected with an input terminal of the same-phase hysteresis comparator 32, and an output terminal of the same-phase hysteresis comparator 32 is coupled or connected to the timing control circuit 4.

In the following, with reference to FIG. 3 and FIG. 4, a specific embodiment of the comparing circuit 3 is provided in detail.

Figure 3:
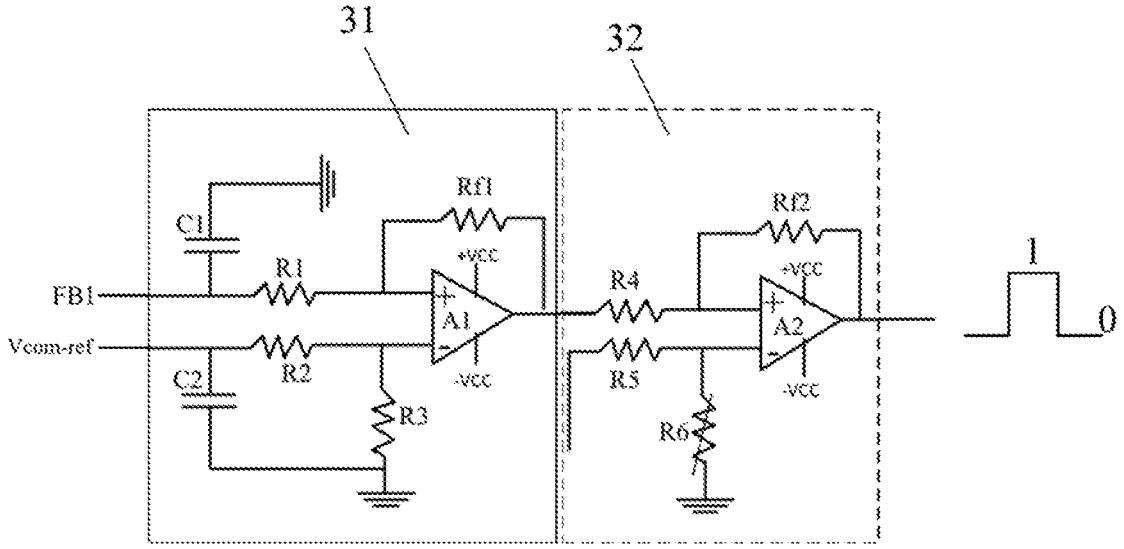
FIG. 3 and FIG. 4 illustrate a circuit diagram of a comparing circuit 3 of the display driving device as described in FIG. 2 corresponding to each of the plurality of regions in the display panel 1.

FIG. 3 illustrates a circuit diagram of a comparing circuit 3 corresponding to region No.: 1 according to some embodiments of the present disclosure.

As shown in FIG. 3, the subtraction operator 31 of the comparing circuit 3 includes a first capacitor C1, a second capacitor C2, a first resistor R1, a second resistor R2, a third resistor R3, a seventh resistor Rf1, and a first comparator A1.

A first terminal of the first capacitor C1 is coupled to a first low level terminal, and a second terminal of the first capacitor C1 is coupled to FB1 (i.e. a common voltage terminal that is coupled to the detecting circuit 2 corresponding to region No.: 1) and a first terminal of the first resistor R1. A first terminal of the second capacitor C2 is coupled to a second low level terminal and a first terminal of the third resistor R3, and a second terminal of the second capacitor C2 is coupled to the reference voltage terminal $V_{com_ref}$ and a first terminal of the second resistor R2.

A second terminal of the first resistor R1 is coupled to a first terminal of the first comparator A1 and a first terminal of the seventh resistor Rf1. A second terminal of the second resistor R2 is coupled to a second terminal of the first comparator A1 and a second terminal of the third resistor R3. A second terminal of the seventh resistor Rf1 is coupled to a third terminal of the first comparator A1.

Further as shown in FIG. 3, the same-phase hysteresis comparator 32 of the comparing circuit 3 includes a fourth resistor R4, a fifth resistor R5, a sixth resistor R6, an eighth resistor Rf2, and a second comparator A2.

A first terminal of the fourth resistor R4 is coupled to the third terminal of the first comparator A1, and a second terminal of the fourth resistor R4 is coupled to a first terminal of the eighth resistor Rf2 and a first terminal of the second comparator A2. A first terminal of the fifth resistor R5 is coupled to a power source, and a second terminal of the fifth resistor R5 is coupled to a second terminal of the second comparator A2 and a first terminal of the sixth resistor R6. A second terminal of the sixth resistor R6 is coupled to a third low level terminal. A second terminal of the eighth resistor Rf2 is coupled to a third terminal of the second comparator A2, and the third terminal of the second comparator A2 is coupled to the timing control circuit 4 (not shown in FIG. 3).

It is noted that the six resistor R6 can be preferably configured as an adjustable resistor.

Herein, the first low level terminal, the second low level terminal, and the third low level terminal can each be a ground terminal, but each can also be a terminal providing a low level signal.

Figure 4:
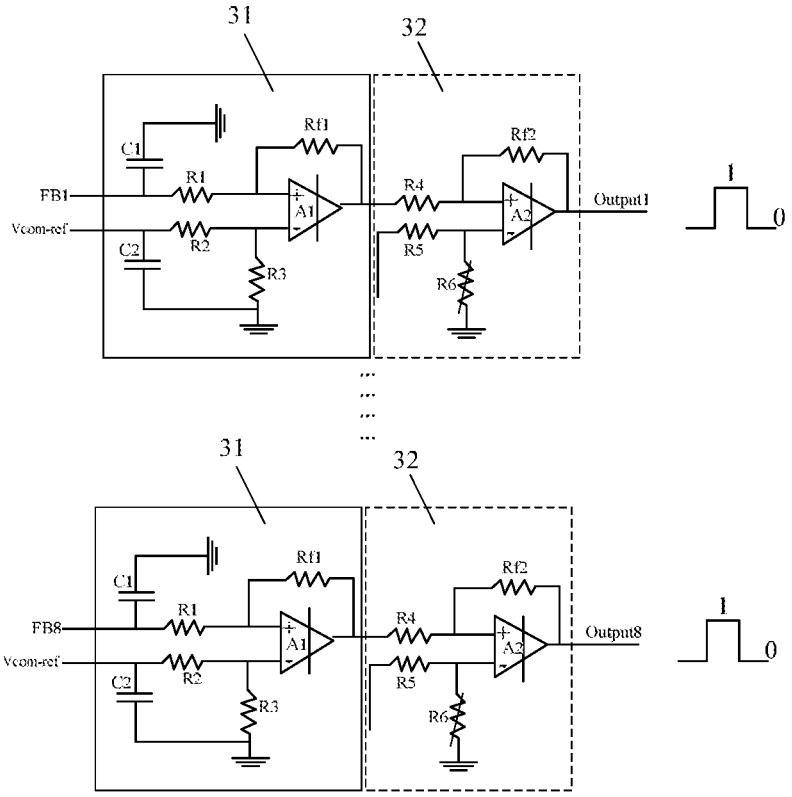

The circuit diagrams of a comparing circuit 3 corresponding to each of the other seven regions (i.e. region Nos.: 2-8) are illustrated in FIG. 4, which is substantially similar to the circuit diagram of the comparing circuit 3 corresponding to region No.: 1, and the description thereof is skipped herein.

It is noted that in each of the comparing circuits 3 corresponding to each of the eight regions (i.e. region Nos: 1-8), each of the components (e.g. R1, R2, R3, etc.) in the corresponding comparing circuit 3 is preferably an independent component.

According to some embodiments, the comparing circuit 3 further includes a reference voltage controller 33 coupled to the subtraction operator 31 and configured to control a threshold range of the reference voltage. In other words, the reference voltage $V_{com_ref}$ can be configured to be adjustable based on practical needs.

According to some embodiments, the display driving device further includes a compensation circuit 5, which is configured to compensate for the common voltage of the display panel 1 based on the reference voltage. Specifically, the compensation circuit 5 is configured such that a first terminal thereof is coupled to the display panel 1, and a second terminal thereof is coupled to the reference voltage controller 33. The compensation circuit 5 can thus compensate for the common voltage of the display panel 1 based on the reference voltage.

It is noted that the way for the compensation circuit 5 to compensate for the common voltage of the display panel 1 based on the reference voltage can be referenced to a usual manner employed by people of ordinary skills in the field.

Additionally, upon detecting that a common voltage from a certain region is abnormal, the data signal corresponding to the involved region can also be compensated for through the timing control circuit 4. The compensation can be made in a usual manner that is typically employed by those of ordinary skills in the field. For instance, the timing control circuit 4 can make a compensation of ΔV±Vdata to the data signal corresponding to the involved region.

Figure 5:
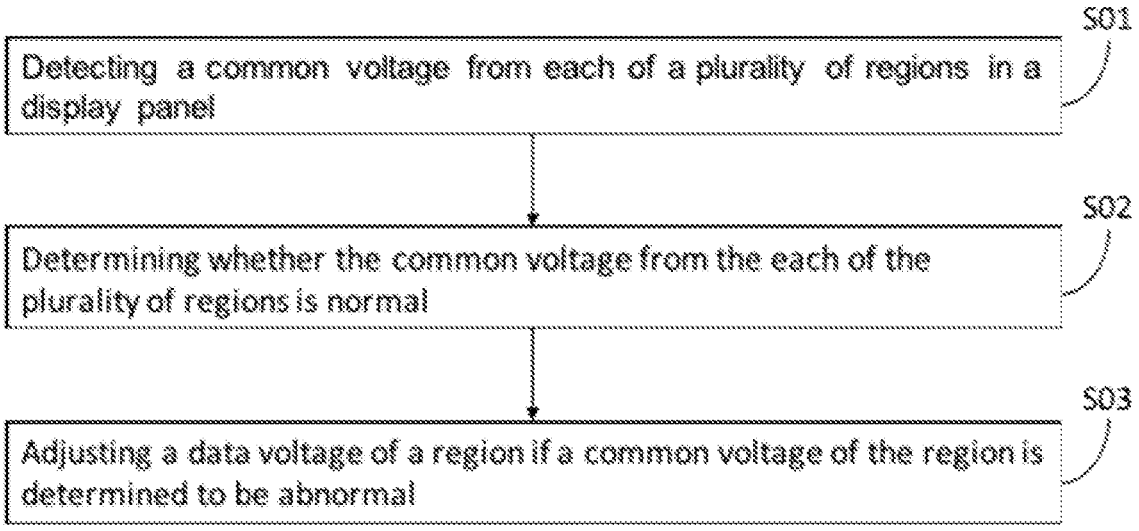
FIG. 5 is a flow chart of a display driving method disclosed herein.

In another aspect, the disclosure further provides a display driving method, as illustrated in FIG. 5. The display driving method comprises the following steps:

S01: detecting a common voltage from each of a plurality of regions in a display panel;

S02: determining whether the common voltage from the each of the plurality of regions is normal; and

S03: adjusting a data voltage of a region if a common voltage of the region is determined to be abnormal.

Figure 6:
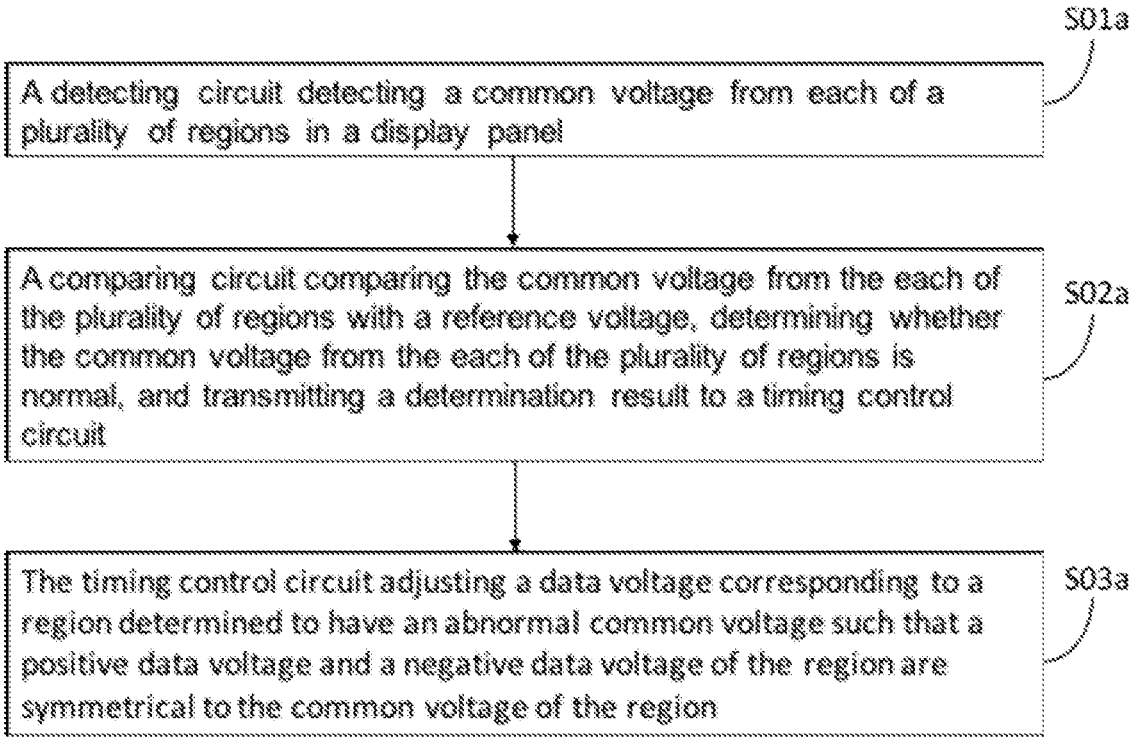
FIG. 6 is a flow chart of a display driving method according to some embodiments of the disclosure.

Employing the display driving device as described above, the display driving method can specifically include the following steps, as illustrated in FIG. 6:

S01*a*: a detecting circuit 2 detecting a common voltage from each of a plurality of regions in a display panel 1;

S02*a*: a comparing circuit 3 comparing the common voltage from the each of the plurality of regions with a reference voltage, determining whether the common voltage from the each of the plurality of regions is normal, and transmitting a determination result to a timing control circuit 4; and

S03*a*: the timing control circuit 4 adjusting a data voltage corresponding to a region determined to have an abnormal common voltage such that a positive data voltage and a negative data voltage of the region are symmetrical to the common voltage of the region.

Specifically, in step S02*a*, the sub-step of comparing the common voltage from the each of the plurality of regions with a reference voltage can include:

A subtraction operator 31 calculating an absolute value of each individual voltage difference between the reference voltage and each individual common voltage.

Furthermore, in step S02*a*, the sub-step of determining whether the common voltage from the each of the plurality of regions is normal can include:

A same-phase hysteresis comparator 32 converting the absolute value of the voltage difference obtained from the subtraction operator 31 into a logic signal.

To be more specific, the above mentioned sub-step of determining whether the common voltage from the each of the plurality of regions is normal can be performed based on the following formula:

$$\begin{cases} |(FB_x - V_{com_ref})| \le \varepsilon; \text{ output: } 0 \\ |(FB_x - V_{com_ref})| > \varepsilon; \text{ output: } 1 \end{cases}$$

where FBx is each individual common voltage corresponding to each individual region of the display panel 1 that has been detected; $V_{com_ref}$ is the reference voltage; ε is the deviation of each individual common voltage from the reference voltage.

Preferably, $0<\varepsilon\le n$ and $0.3\le n\le 0.6$.

Preferably, in step S01*a* (i.e. a detecting circuit 2 detecting a common voltage from each of a plurality of regions in a display panel 1), the plurality of regions consists of edge regions.

According to some embodiments, the display panel 1 includes a total of nine regions, and as such, step S01*a* (i.e. a detecting circuit 2 detecting a common voltage from each of a plurality of regions in a display panel 1) includes:

A detecting circuit 2 detecting a common voltage from each of eight edge regions in a display panel 1.

It is noted that there can be a variety of different embodiments for the method as described above. For example, the subtraction operator 31 can be adjusted to have different connections based on practical needs and the reference voltage can be adjusted to have a different value based on practical needs.

In yet another aspect, the present disclosure provides a display apparatus, which includes a display driving device according to any of the embodiments as described above. Specifically, the display apparatus can be a liquid crystal display panel, an e-paper, a cellular phone, a tablet, a TV, a monitor, a notebook computer, a digital camera, a GPS device, or an electronic product or component having a display functionality.

Although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the exemplary embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

The invention claimed is:

1. A display driving device for driving a display panel, comprising:

a detecting circuit;

a comparing circuit, coupled to the detecting circuit; and a timing control circuit, coupled to the comparing circuit;

wherein:

the detecting circuit is configured to detect, and to send to the comparing circuit, a common voltage from each of at least one of a plurality of regions in the display panel;

the comparing circuit is configured to compare the common voltage with a reference voltage, to determine whether the common voltage is normal, and to send a determination result to the timing control circuit;

the timing control circuit is configured, based on the determination result, to adjust a data voltage of a region having a common voltage determined to be abnormal so as to allow a positive data voltage and a negative data voltage of the region to be symmetrical to the common voltage of the region;

the comparing circuit comprises a subtraction operator and a same-phase hysteresis comparator;

the subtraction operator is configured to calculate, and to send to the same-phase hysteresis comparator, an absolute value of a voltage difference between the reference voltage and the common voltage from the each of the plurality of regions; and the same-phase hysteresis comparator is configured to convert the absolute value of the voltage difference into a logic signal.

2. The display driving device of claim 1, wherein:

the detecting circuit is coupled to an input terminal of the subtraction operator;

an output terminal of the subtraction operator is coupled to an input terminal of the same-phase hysteresis comparator; and an output terminal of the same-phase hysteresis comparator is coupled to the timing control circuit.

3. The display driving device of claim 1, wherein the subtraction operator comprises a first capacitor, a second capacitor, a first resistor, a second resistor, a third resistor, a seventh resistor, and a first comparator, wherein:

a first terminal of the first capacitor is coupled to a first low level terminal;

a second terminal of the first capacitor is coupled to a common voltage terminal of the detecting circuit corresponding to the each of the plurality of regions and a first terminal of the first resistor;

a first terminal of the second capacitor is coupled to a second low level terminal and a first terminal of the third resistor;

a second terminal of the second capacitor is coupled to the reference voltage terminal $V_{com_ref}$ and a first terminal of the second resistor;

a second terminal of the first resistor is coupled to a first terminal of the first comparator and a first terminal of the seventh resistor;

a second terminal of the second resistor is coupled to a second terminal of the first comparator and a second terminal of the third resistor; and a second terminal of the seventh resistor is coupled to a third terminal of the first comparator.

4. The display driving device of claim 3, wherein the same-phase hysteresis comparator comprises a fourth resistor, a fifth resistor, a sixth resistor, an eighth resistor, and a second comparator, wherein:

a first terminal of the fourth resistor is coupled to the third terminal of the first comparator;

a second terminal of the fourth resistor is coupled to a first terminal of the eighth resistor and a first terminal of the second comparator;

a first terminal of the fifth resistor is coupled to a power source;

a second terminal of the fifth resistor is coupled to a second terminal of the second comparator and a first terminal of the sixth resistor;

a second terminal of the sixth resistor is coupled to a third low level terminal;

a second terminal of the eighth resistor is coupled to a third terminal of the second comparator; and the third terminal of the second comparator is coupled to the timing control circuit.

5. The display driving device of claim 1, wherein the comparing circuit further comprises a reference voltage controller, coupled to the subtraction operator and configured to control a threshold range of the reference voltage.

6. The display driving device of claim 5, further comprising a compensation circuit, wherein:

a first terminal thereof is coupled to the display panel, and a second terminal thereof is coupled to the reference voltage controller; and the compensation circuit is configured to compensate for the common voltage of the each of the plurality of regions based on the reference voltage.

7. The display driving device of claim 1, wherein the each of at least one of the plurality of regions is an edge region of the display panel.

8. The display driving device of claim 7, wherein the display panel is divided into nine regions, and the at least one of the plurality of regions consist of eight regions that are each the edge region.

9. The display driving device of claim 1, wherein the detecting circuit comprises a plurality of detecting lines, coupled to the plurality of regions, wherein:

each of the plurality of detecting lines is coupled to one of the plurality of regions, and is configured to respectively obtain one common voltage therefrom.

10. A method for driving a display panel, comprising:

detecting a common voltage from each of a plurality of regions in a display panel;

determining whether the common voltage from the each of the plurality of regions is normal; and adjusting a data voltage of a region if a common voltage of the region is determined to be abnormal;

wherein the determining whether the common voltage from the each of the plurality of regions is normal comprises:

comparing the common voltage from the each of the plurality of regions with a reference voltage to thereby obtain a deviation of the common voltage; and determining that the common voltage is abnormal if the deviation of the common voltage is more than a threshold, or normal if otherwise; and wherein the threshold is more than 0 and no less than n, where $0.3 \leq n \leq 0.6$.

11. The method of claim 10, wherein the comparing the common voltage from the each of the plurality of regions with a reference voltage to thereby obtain a deviation of the common voltage comprises:

calculating an absolute value of a voltage difference between the reference voltage and the common voltage from the each of the plurality of regions.

12. A method for driving a display panel, comprising:

detecting a common voltage from each of a plurality of regions in a display panel;

determining whether the common voltage from the each of the plurality of regions is normal; and adjusting a data voltage of a region if a common voltage of the region is determined to be abnormal;

wherein the determining whether the common voltage from the each of the plurality of regions is normal comprises:

comparing the common voltage from the each of the plurality of regions with a reference voltage to thereby obtain a deviation of the common voltage; and determining that the common voltage is abnormal if the deviation of the common voltage is more than a threshold, or normal if otherwise; and wherein after the determining that the common voltage is abnormal if the deviation of the common voltage is more than a threshold, or normal if otherwise, the determining whether the common voltage from the each of the plurality of regions is normal further comprises:

converting the absolute value of the voltage difference into a logic signal.

13. The method of claim 10, wherein the adjusting a data voltage of a region if a common voltage of the region is determined to be abnormal comprises:

adjusting the data voltage of the region such that a positive data voltage and a negative data voltage of the region are symmetrical to the common voltage of the region.

14. The method of claim 13, wherein the adjusting the data voltage of the region comprises:

lowering a positive potential signal from a signal source to thereby allow a symmetry with a negative potential signal.

15. The method of claim 10, wherein each of the plurality of regions is an edge region of the display panel.

16. The method of claim 15, wherein the display panel is divided into nine regions, and the plurality of regions consist of eight regions that are each an edge region.

17. A display apparatus, comprising a display driving device according to claim 1.

* * * * *